United States Patent [19]

Vladic

[11] 4,106,841

[45] Aug. 15, 1978

[54] ELECTRICAL CONNECTOR FOR PRINTED CIRCUIT BOARDS

[75] Inventor: Daniel P. Vladic, Berwyn, Ill.

[73] Assignee: Bunker Ramo Corporation, Oak Brook, Ill.

[21] Appl. No.: 776,932

[22] Filed: Mar. 11, 1977

[51] Int. Cl.[2] ..... H01R 13/50

[52] U.S. Cl. ..... 339/176 M; 339/176 MP

[58] Field of Search ..... 339/176 M, 176 MP

[56] References Cited

U.S. PATENT DOCUMENTS

| | | | |
|---|---|---|---|
| 3,015,083 | 12/1961 | Juris | 339/176 MP |
| 3,231,848 | 1/1966 | Ruehlemann | 339/176 MP |
| 3,289,146 | 11/1966 | Tuchel | 339/176 MP |
| 3,335,398 | 8/1967 | Clewes | 339/176 MP |
| 3,903,385 | 9/1975 | Moyer | 339/176 MP |

*Primary Examiner*—Roy Lake
*Assistant Examiner*—Paul A. Bell
*Attorney, Agent, or Firm*—William Lohff; F. M. Arbuckle

[57] ABSTRACT

A connector assembly for printed circuit boards and the like includes a housing having a cavity and an elongated slot communicating with the cavity through which a male connector or printed circuit board may be inserted. Disposed within the cavity are a plurality of electrical contacts each of which is adapted to engage and electrically contact a conductive strip located on the printed circuit board. Each electrical contact is adapted to maintain its electrical continuity independent of the printed circuit board until the circuit board is in electrical engagement therewith.

14 Claims, 5 Drawing Figures

ELECTRICAL CONNECTOR FOR PRINTED CIRCUIT BOARDS

BACKGROUND OF THE INVENTION

This invention generally relates to electrical connectors and more particularly to electrical connectors for printed circuit boards. Specifically, this invention relates to an improved electrical contact structure within an electrical connector for printed circuit boards whereby the electrical contact maintains electrical continuity independent of the circuit board until the circuit board achieves electrical contact therewith.

Connector assemblies for interconnecting printed circuit boards have utilized a wide variety of electrical contact structures to hold and electrically interconnect the circuit boards such as disclosed in U.S. Pat. Nos. 3,970,353, 3,980,376 and 3,980,377. One common structure utilizes a plurality of paired contact clips or flat wires uniformly arranged in a row so as to contact and press against conductive strips on both sides of an insertable printed circuit board. In such arrangements, the contact members of each pair of wires or clips are normally not in contact with each other and therefore are not part of a circuit until the printed circuit board has been inserted and makes contact between the pair of clips. However, it is sometimes highly desirable or even necessary to maintain an electrical continuity or closed circuit between the paired contact members without the presence of a circuit board therebetween, such as for circuit board testing purposes. Therefore, in such systems some type of contact between the paired electrical contacts is necessary.

Previous designs to achieve the above generally included paired electrical contact members having a single contact point, commonly known as "shorted" contacts, whereby a continuous closed circuit is constantly maintained directly between the biased contact members until separated by the insertion of a circuit board therebetween. One problem with such a design is that the closed circuit or electrical continuity between the paired contact members is broken prior to their achieving direct electrical contact with the circuit board.

The present invention overcomes the above problem by achieving a continuous electrical continuity or closed circuit without the presence of a circuit board and maintaining such a closed circuit until the electrical contact members are engaged with and in electrical contact with the circuit board, at which point the direct circuit between the contact members ceases. Thus, the electrical continuity of the connector assembly is never broken.

It is, therefore, one object of the present invention to provide an improved electrical connector assembly for use with printed circuit boards.

Another object of the present invention is to provide improved electrical contact means within a connector assembly for printed circuit boards.

A further object of the present invention is to provide electrical contact means within a connector assembly for printed circuit boards which independently maintain electrical continuity until the circuit board is in electrical contact therewith.

SUMMARY OF THE INVENTION

This invention is directed to a female connector assembly adapted to receive and electrically contact a male connector such as a printed circuit board. The female connector includes a cavity therewithin which is adapted to receive the printed circuit board and which contains one or more electrical contact means adapted to engage and make electrical contact with the circuit board. Each electrical contact means preferably comprises a pair of opposed electrical contact members each of which includes two contact portions for making contact with a conductive strip located on the printed circuit board. Each contact member is sized and shaped so that the paired members are laterally deflectable away from each other as the printed circuit board is inserted into the connector assembly and between the paired contact members. In addition, the second contact portion of each contact member is biased against the second contact portion of its paired contact member so that the paired contact members independently maintain electrical continuity therebetween without the presence of the circuit board.

The bias force between the second contact portions of the paired contact members is sufficiently great so that electrical continuity is maintained therebetween while the first contact portions are moved laterally away from each other by the insertion of the circuit board into the connector assembly. Once the circuit board has been sufficiently inserted to make electrical contact with the first contact portions of the paired contact members, further insertion of the circuit board into the connector assembly overcomes the bias force between the second contact portions and forces them apart so that the second contact portions of the contact members also come into contact with the printed circuit board. In this manner, electrical contact by the connector assembly is made with the printed circuit board before the electrical continuity between the contact members is broken. Thus, a closed electrical circuit is continually maintained by the contact members irrespective of the presence of a printed circuit board.

DETAILED DESCRIPTION OF THE PREFERRED EMBODIMENT

Figure 1:
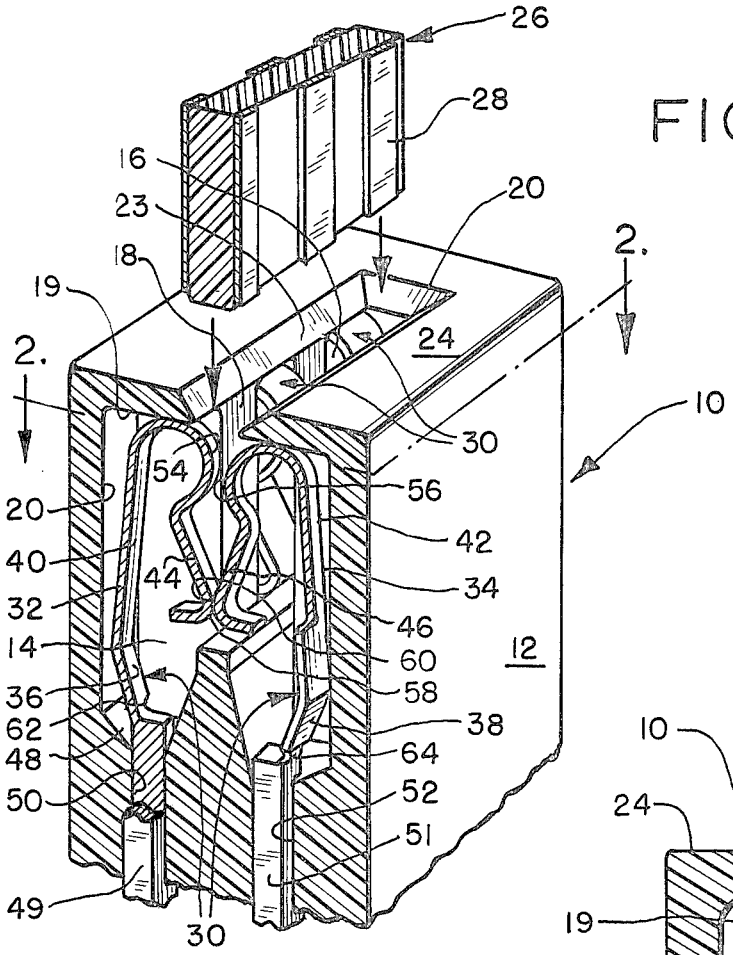
FIG. 1 is a partial, front schematic perspective view, with some parts in section and some in elevation, of a connector assembly and electrical contact means of the present invention and illustrating the entry position of a printed circuit board.
Figure 2:
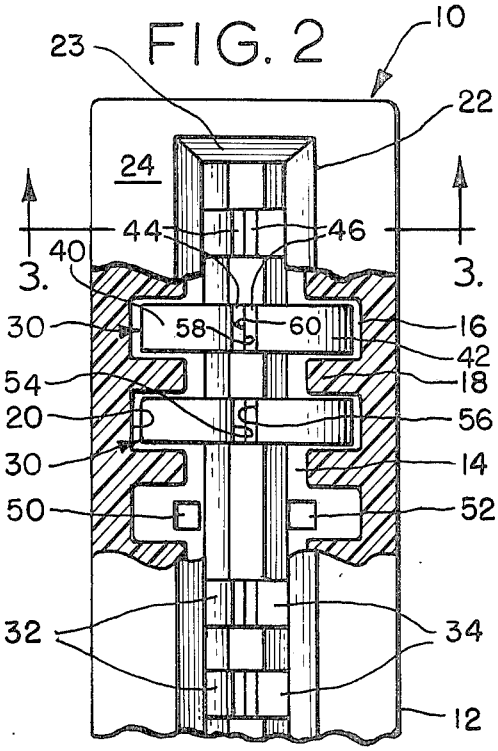
FIG. 2 is a schematic top plan view illustrating the connector assembly shown in FIG. 1, a portion of the top being broken away substantially along line 2—2 of FIG. 1.

Turning first to FIG. 1, there is shown a female embodiment of an electrical connector assembly 10 which preferably includes a housing 12 made from a dielectric material such as plastic and generally formed by injection molding or the like. Housing 12 may be constructed in any conventional form known to the art in that housing 12 merely functions as a receptacle and a holding means for the electrical contact means of the present invention. Disposed within housing 12 is a cavity 14 which in the illustrated embodiment is subdivided into partially enclosed compartments 16 by dividers 18. The dividers 18 preferably extend from the top 19 to the bottom 48 of the cavity 14 and from the side walls 20 of the cavity 14 toward the cavity center. The dividers 18, as described in more detail below, also act as guides and electrical insulators.

An elongated slot 22 with beveled guide edges 23 extends through the top 24 of the housing 12 and communicates with the cavity 14, the slot 22 being bounded by the inward edges of the dividers 18. The slot 22 is provided so that a male connector 26, such as the preferred printed circuit board illustrated in the figures, may be inserted therethrough and be received within the cavity 14. In the illustrated embodiment, the circuit board 26 contains a plurality of electrically conductive strips 28 along both sides thereof as is conventional in the art. While housing 12 and slot 22 are preferably sized and shaped to receive the illustrated printed circuit board 26, it should be understood that housing 12 and slot 22 may be sized and shaped to receive any male connector or receptacle.

Figure 3:
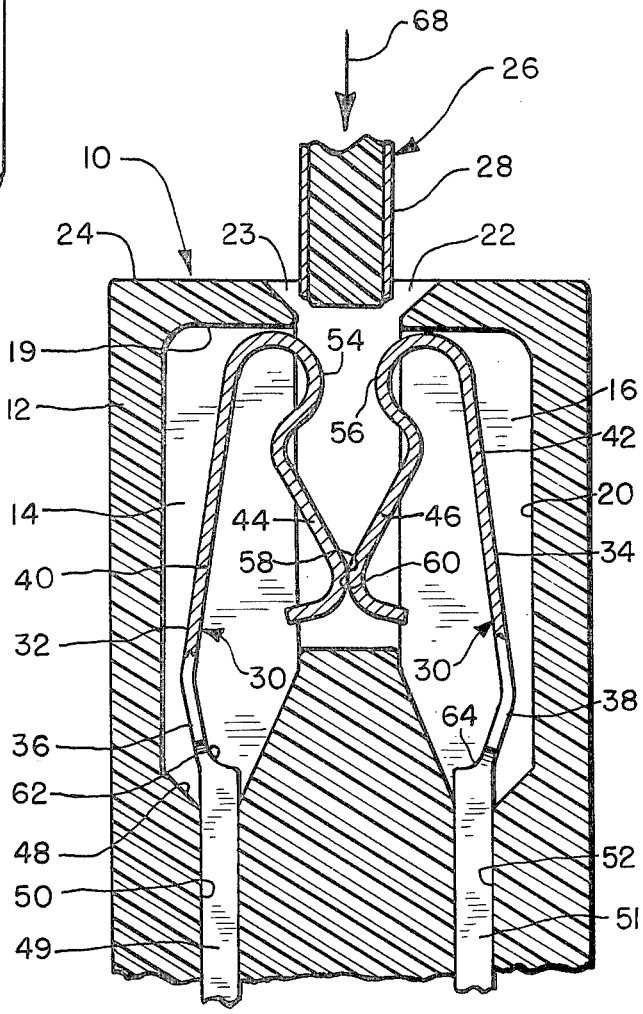
FIG. 3 is a schematic cross-sectional view taken substantially along line 3—3 of FIG. 2 and illustrating the insertion position of the printed circuit board relative to the connector assembly of the present invention.
Figure 4:
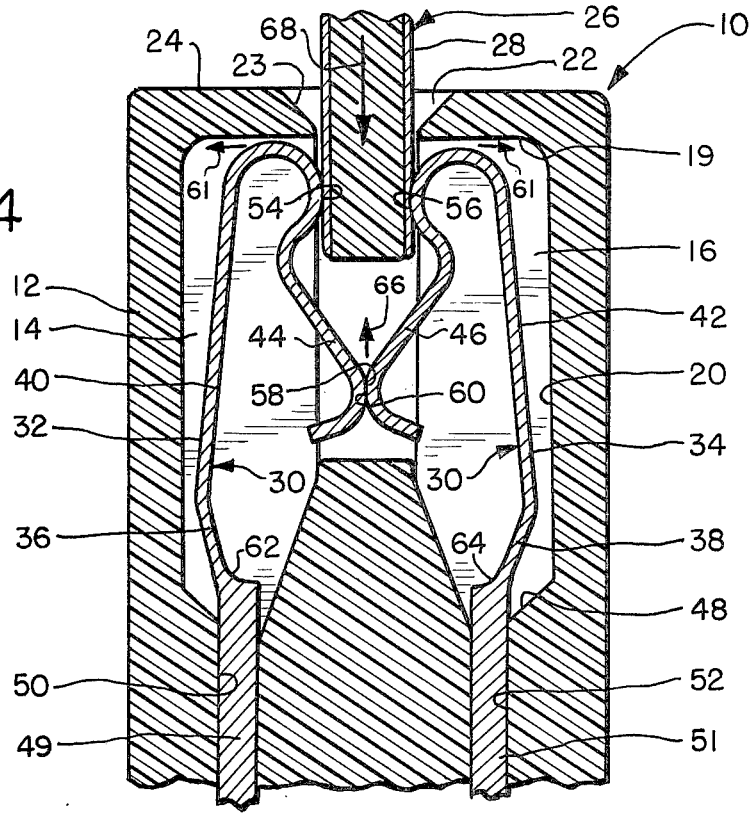
FIG. 4 is a schematic cross-sectional view similar to FIG. 3 but illustrating the printed circuit board partially inserted into the connector assembly and electrically engaged by the first contact portions of the electrical contact means of the present invention.
Figure 5:
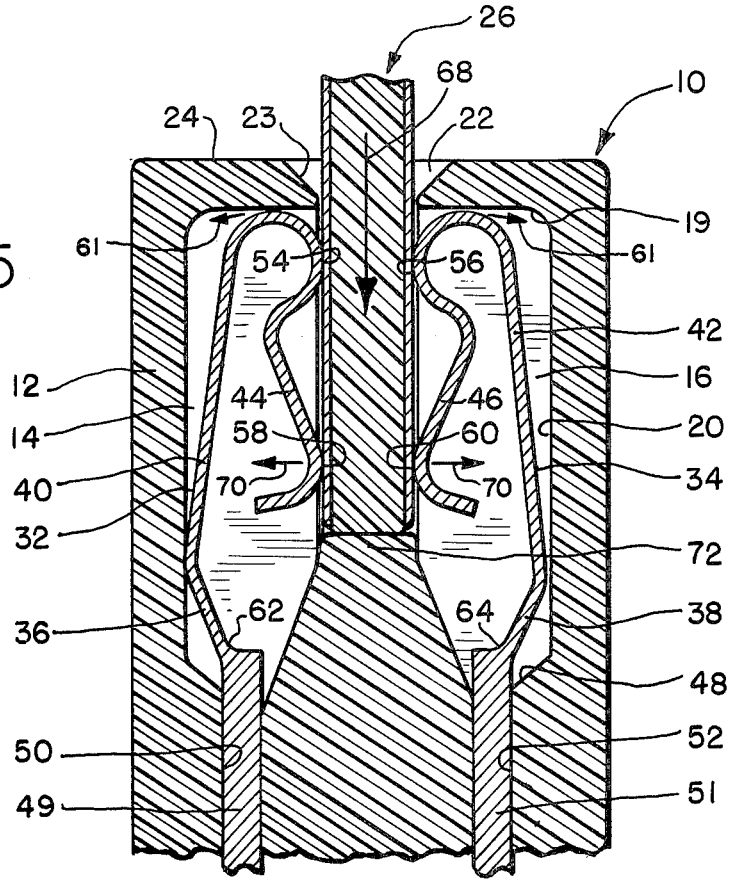
FIG. 5 is a schematic cross-sectional view similar to FIGS. 3 and 4 but illustrating the complete insertion of the printed circuit board into the connector assembly and its engagement with both first and second contact portions of the electrical contact means of the present invention.

Referring in more detail to FIGS. 3, 4 and 5, a plurality of electrical contact means 30 are disposed within the cavity 14. Contact means 30 are adapted to engage and electrically contact the printed circuit board 26 as the circuit board 26 is inserted through the slot 22 into the cavity 14. In preferred form, the contact means 30 comprises a pair of opposing contact members 32, 34. In the illustrated embodiment, contact members 32, 34 are identical but oppositely oriented deflectable spring contacts comprised of terminal base segments 36, 38, flexible essentially hook-shaped segments 40, 42 which project upwardly from terminal segments 36, 38, respectively, toward slot 22, and essentially S-shaped segments 44, 46 which are secured to the curved portions of segments 40, 42, respectively, and extend downwardly toward the bottom 48 of the cavity 14. Each terminal segment 36, 38 is preferably mounted in an orifice 50, 52 located in the bottom 48 of the cavity 14. The terminal portions 49, 51 of segments 36, 38 are electrically connected in any conventional manner to insulated conductors (not shown) within orifices 50, 52.

In the preferred embodiment, hook-shaped segments 40, 42 and S-shaped segments 44, 46 have a rectangular crosssection of a preferred size of 0.010 by 0.045 inch, and the terminal portions 49, 51 of terminal base segments 36, 38 have a square cross-section of 0.025 inch. However, the exact dimensions may be varied depending on the material used and the desired connector assembly size.

The shape of contact member 32 creates a first contact means or portion 54 located toward the end of the curved portion of hook shaped segment 40. Likewise, contact member 34 has a first contact means or portion 56 located toward the end of the curved portion of hook-shaped segment 42. Thus, first contact portions 54, 56 are located and spaced apart immediately opposite each other directly below slot 22. Contact member 32 also has a second contact means or portion 58 located at the bottom curved section of S-shaped segment 44. Likewise, contact member 34 has a second contact means or portion 60 located toward the lower end of S-shaped segment 46. Contact members 32 and 34 are sized and shaped so that the second contact portions 58 and 60 are biased against each other beneath the spaced-apart first contact portions 54 and 56. The biasing force results from the shapes of contact members 32 and 34 such that a prestressed or loaded condition occurs in the mid-sections of S-shaped segments 44, 46 which are relatively inflexible.

The contact members 32 and 34 may be constructed from any electrically conductive, solderable material, and preferably contact portions 54, 56, 58 and 60 contain additional electrically conductive material such as gold or nickel-silver alloy (not shown) at their surface contact areas. In this manner, contact member 32 maintains electrical continuity with contact member 34 through the contact of second contact portions 58, 60 until they are separated by the insertion of printed circuit board 26, as described below. It should be noted that the elongated portions of hook-shaped segments 40, 42 are more flexible than the mid-sections of S-shaped segments 44, 46 for reasons described below. It should further be noted that the exact radius of each curved portion and the exact length of each straight portion of contact members 32 and 34 may be varied depending on the tensile strength of the materials utilized and the overall dimensions of the connector assembly and variances in the radii of the upper two curved portions of each contact member 32, 34 will directly vary the amount of bias force applied at the second contact portions 58, 60.

Referring to the operation of the present invention as illustrated in FIGS. 3, 4 and 5, a closed electrical circuit is maintained by electrical contact means 30 without the presence of a male connector or printed circuit board 26 within the connector assembly 10 by the continuous contact of the second contact portions 58 and 60 of the contact members 32, 34. As described above, the first contact portions 54 and 56 are spaced apart immediately opposite each other beneath the slot 22. When it is desired to alter this closed circuit by inserting a printed circuit board 26 within the cavity 14, the circuit board 26 is extended downwardly through the slot 22, as shown in FIG. 3 and indicated by arrow 68, until the circuit board 26 contacts the contact members 32, 34 at the first contact portions 54, 56, as illustrated in FIG. 4. As this occurs, the circuit board 26 deflects the first contact portions 54, 56 of the contact members 32, 34 laterally away from each other, as indicated by arrows 61, due to the flexibility of the elongated portions of hook-shaped segments 40, 42 and the narrowed areas 61, 64 on the terminal base segments 36, 38 of the contact members 32, 34. At this point, the first contact portions 54, 56 come into direct electrical contact with the conductive strips 28 on the circuit board 26. However, due to the pretensioning of the mid-sections of the S-shaped segments 44, 46 which imposes the biasing load between the second contact portions 58, 60, the contact members 32, 34 remain in electrical contact at the second contact portions 58, 60 which tend to move together upwardly toward the slot 22, as indicated by arrow 66, as the first contact portions 54, 56 are moved laterally.

Once electrical contact has been achieved between the first contact portions 54, 56 and the conductive strips 28 of the printed circuit board 26, further downward movement of the printed circuit board 26 overcomes the bias load imposed on the second contact portions 58, 60 and forces them to separate, as indicated by arrows 70 in FIG. 5. The second contact portions thus come into electrical contact with the conductive strip 28 of the circuit board 26, and this completely separates the contact members 32 and 34 from direct electrical contact with each other and thereby breaks the electrical continuity therebetween. An end stop projects upwardly from the bottom 48 of the cavity 14 to stop the downward movement of the circuit board 26 within the cavity 14.

It should be noted that the conductive strips 28 of the circuit board 26 tend to build up oxide layers thereon, the first contact portions 54, 56 of the contact members 32, 34 provide a wiping action against the conductive strips 28 to insure a clean contact and therefore a complete, circuit, the second contact portions 58, 60 of the contact members 32, 34 providing the main electrical contact with the circuit board 26. Therefore, while the first contact portions 54, 56 may wear somewhat due to their wiping action function, the second contact portions 58, 60 are not greatly affected by such wearing action. Thus, the present invention tends to have a longer life span than previous electrical contact arrangements. Furthermore, the present invention, with its double contact area, does not noticeably alter the insertion force required for the printed circuit board 26 as compared with the insertion force required with previous "shorted" contact arrangements.

Finally, the biasing force exerted by the contact members 32, 34 against the sides of the printed circuit board 26, when the board 26 is completely engaged between the contact members 32, 34 as shown in FIG. 5, maintains the circuit board 26 securely within the cavity 14.

As initially described, each connector assembly may include a plurality of paired contact members arranged in a row so that each contact member of each pair of members contacts one side of an inserted circuit board. The conductive strips 28, located along the sides of the circuit board 26, are aligned so as to come into contact with the contact members 32, 34 when the circuit board 26 is inserted within the connector assembly. Dividers 18 function as guides for the individual contact members as well as separating each contact member to prevent any possibility of physical contact between adjacent electrical contact members within the connector assembly.

It should also be noted that another possible embodiment of the present invention would utilize only one contact member rather than opposing paired members as described above, the second contact portion of such a contact member being biased against an electrically conductive wall or horizontal strip within the cavity 14 prior to insertion of the printed circuit board between such a wall and the contact member.

From the above, it can be seen that the present invention enables the electrical contact means within the connector assembly to independently maintain electrical continuity therein until the male connector or printed circuit board is electrically contacted thereby. This prevents an interruption in the electrical continuity of the circuits, and provides for a normally closed circuit without the presence of a printed circuit board.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein, but may be modified within the scope of the appended claims.

I claim:

1. A connector comprising:

housing means adapted to receive a male connector therein, and electrical contact means including at least one pair of opposing, laterally movable contact members for receiving and electrically contacting said male connector therebetween and having electrically isolated terminal base portions, each said contact member including first and second contact portions spaced longitudinally from a fixed terminal base portion about which said member is laterally movable, said second contact portions of each said pair of members being biased against each other to maintain electrical continuity therebetween independent of said male connector until said male connector is electrically contacted by said first contact portions, said first and second contact portions being spaced from said fixed terminal base portions such that lateral movement of opposing first contact portions of each pair of members in response to insertion of said male connector therebetween decreases the bias force between said biased second contact portions to permit ready separation thereof in response to continued insertion of said male connector.

2. The connector as described in claim 1, wherein each said fixed terminal base portion defines a pivot point for said lateral movement of its said contact member, the portion of its said contact member movable about said pivot point and including said first and second contact portions being free standing relative to said housing means.

3. The connector as described in claim 2, wherein said pair of opposing contact members is adapted to exert a lateral biasing force on said male connector when said male connector is interposed between said pair of contact members, thereby maintaining said male connector in position therebetween.

4. A connector as described in claim 1, wherein each said contact member of said pair of contact members comprises one of said fixed terminal base portions, a flexible, essentially hook-shaped segment projecting longitudinally at one end from the terminal base portion of said contact member and terminating in one of said first contact portions, and an essentially S-shaped segment secured at one end to the first contact portion of said contact member and having one of said second contact portions disposed near its opposite end, the mid-section of the S-shaped segment being relatively inflexible and adapted to provide a lateral force at its second contact portion to bias the second contact portions of said pair of opposed contact members against each other, both said first and second portions of each contact member being disposed above a plane transverse to the fixed terminal base portion of the contact member.

5. An electrical contact for use in a connector comprising a pair of opposed contact members adapted for lateral movement to receive and electrically contact a male connector therebetween and having electrically isolated terminal base portions, each said contact member having movable first and second active contact portions spaced longitudinally from a fixed terminal base portion about which said member is movable for electrically contacting said male connector, said second contact portions of said pair of opposed contact members being biased against each other to continuously maintain electrical continuity therebetween until said male connector is electrically engaged by said first contact portions of said pair of contact members, said first and second contact portions being spaced from said fixed terminal base portions such that lateral movement of opposing first contact portions in response to insertion of said male connector therebetween decreases the bias force between said biased second contact portions to permit ready separation thereof in response to continued insertion of said male connector.

6. The connector as described in claim 5, wherein each said pair of contact members comprises a pair of spring contacts, and wherein each said fixed terminal base portion defines a pivot point for said lateral movement of its said spring contact member.

7. The electrical contact as described in claim 6, wherein each said spring contact of said pair of spring contacts comprises one of said terminal base portions, a flexible, essentially hook-shaped segment projecting at one end from the terminal base portion of said spring contact and terminating in one of said first contact portions, and an essentially S-shaped segment secured at one end to the first contact portion of said spring contact and having one of said second contact portions disposed near its opposite end, the mid-section of each S-shaped segment being relatively inflexible and adapted to provide a lateral force at its second contact portion to bias said second contact portions of said pair of opposed spring contacts against each other, both said first and second contact portions of each spring contact being disposed above a plane transverse to the fixed terminal base portion of the spring contact.

8. An electrical connector assembly for use with printed circuit boards comprising:

a housing having a cavity therewithin including means for receiving said printed circuit board, and electrical contact means including at least one pair of opposing, laterally movable contact members for engaging and electrically contacting said circuit board therebetween and having electrically isolated terminal base portions, each said contact member including first and second contact portions spaced longitudinally from a fixed terminal base portion about which said member is laterally movable and disposed opposite similar first and second contact portions on the opposing contact member of said pair of members, said second contact portions of said pair of contact members being biased against each other to maintain electrical continuity therebetween until said circuit board is engaged and electrically contacted by said first contact portions, said first and second contact portions being spaced from said fixed terminal base portions such that lateral movement of opposing first contact portions of each pair of members in response to insertion of said circuit board therebetween decreases the bias force between said biased second contact portions to permit ready separation thereof in response to continued insertion of said male connector 9. The electrical connector assembly as described in claim 8, wherein said pair of opposing contact members comprise a pair of opposed deflectable spring contacts adapted for lateral movement to engage said circuit board therebetween and to exert a lateral biasing force on said circuit board when said circuit board is interposed therebetween, thereby maintaining said circuit board in position between said contacts, and wherein each said fixed terminal base portion defines a pivot point for said lateral movement of its said spring contact, the portion of each said spring contact laterally movable about said pivot point and including said first and second contact portions being free standing relative to said housing.

10. The electrical connector assembly as described in claim 9, wherein each said spring contact of said pair of spring contacts comprises one of said terminal base portions, a flexible essentially hook-shaped segment projecting at one end from the terminal base portion of said spring contact and terminating in one of said first contact portions, and an essentially S-shaped segment secured at one end to the first contact portion of said spring contact and having one of said second contact portions disposed near its opposite end, the mid-section of each S-shaped segment being relatively inflexible and adapted to provide a lateral force against its second contact portion thereby biasing said second contact portions of said pair of opposed spring contacts against each other, both said first and second contact portions of each spring contact being disposed above a plane transverse to the fixed terminal base portion of the spring contact.

11. An electrical connector assembly for engaging and electrically contacting a printed circuit board comprising:

a housing having a cavity and an elongated slot communicating with said cavity, and at least one pair of opposing electrical contact members disposed within said cavity beneath said slot and adapted for lateral movement to engage and electrically contact said printed circuit board when said board is inserted through said slot, said contact members having electrically isolated terminal base portions, each contact member of each said pair of contact members including first and second contact portions spaced longitudinally between said slot and a fixed terminal base portion in free standing relationship to said housing, each said fixed base portion defining a pivot point about which its contact member is laterally movable, said second contact portions of each said pair of contact members being biased directly against each other to maintain electrical continuity therebetween independent of said circuit board until said board is engaged and electrically contacted by said first contact portions, said first and second contact portions of each said pair of members being spaced from their respective fixed terminal base portions such that lateral movement of opposing first contact portions of said pair of members in response to insertion of said circuit board therebetween decreases the bias force between said biased second contact portions to permit ready separation thereof in response to continued insertion of said circuit board.

12. In an electrical connector assembly for engaging and electrically contacting printed circuit boards and including a housing having a cavity and an elongated slot communicating with said cavity, and a plurality of paired, opposing electrical contact members disposed within said cavity beneath said slot and adapted for lateral movement to engage and electrically contact said printed circuit board, said contact members having electrically isolated terminal base portions, the improvement wherein each contact member of at least one said pair of electrical contact members includes first and second contact portions spaced longitudinally toward said slot from a fixed terminal base portion which defines a pivot point about which each said member is laterally movable, said second contact portions of each said pair of members being biased against each other to maintain electrical continuity therebetween independent of said circuit board until said circuit board is engaged and electrically contacted by said first contact portions, said first and second contact portions being spaced from said fixed terminal base portions such that lateral movement of opposing first contact portions of each pair of members in response to insertion of said circuit board therebetween decreases the bias force between said biased second contact portions to permit ready separation thereof in response to continued insertion of said circuit board.

13. The improvement as described in claim 12, wherein each said pair of electrical contact members comprises a pair of opposing spring contacts adapted to exert a lateral biasing force on said printed circuit board when said circuit board is interposed between said spring contacts thereby maintaining said circuit board in position therebetween, said plurality of paired electrical contact members being aligned within said housing cavity to maintain said printed circuit board therein, and wherein the portion of each said spring contact movable about its pivot point and including said first and second contact portions is free standing relative to said housing.

14. The improvement as described in claim 13, wherein each said spring contact of each said pair of spring contacts comprises one of said terminal base portions, a flexible, essentially hook-shaped segment projecting at one end from the terminal base portion of said spring contact toward said elongated slot and terminating in one of said first contact portions, and an essentially S-shaped segment extending away from said elongated slot and secured at one end to the first contact portion of said spring contact with one of said second contact portions disposed at its opposite end, the mid-section of each S-shaped segment being relatively inflexible and adapted to bias its second contact portion against the second contact portion of the opposing spring contact of said pair of spring contacts, both said first and second contact portions of each spring contact being disposed above a plane transverse to the pivot point of the spring contact.

* * * * *